US008813274B2

(12) United States Patent
Atassi

(10) Patent No.: US 8,813,274 B2
(45) Date of Patent: Aug. 26, 2014

(54) MIST FLUSHING SYSTEM FOR TOILETS

(76) Inventor: Mohamed Radwan Rafaat Atassi, Cairo (EG)

( * ) Notice: Subject to any disclaimer, the term of this patent is extended or adjusted under 35 U.S.C. 154(b) by 1761 days.

(21) Appl. No.: 12/733,210

(22) PCT Filed: Nov. 30, 2005

(86) PCT No.: PCT/EG2005/000038
§ 371 (c)(1),
(2), (4) Date: Feb. 16, 2010

(87) PCT Pub. No.: WO2007/062667
PCT Pub. Date: Jun. 7, 2007

(65) Prior Publication Data
US 2010/0325787 A1 Dec. 30, 2010

(51) Int. Cl.
*E03D 1/00* (2006.01)

(52) U.S. Cl.
USPC ..... 4/300; 4/354

(58) Field of Classification Search
USPC ..... 4/300, 354, 363
See application file for complete search history.

(56) References Cited

U.S. PATENT DOCUMENTS 5,596,772 A * 1/1997 Schon ..... 4/354
8,099,802 B2 * 1/2012 Yamaguchi et al. ..... 4/300

FOREIGN PATENT DOCUMENTS

EP 1132531 A2 * 9/2001 ..... E03D 3/10

* cited by examiner

*Primary Examiner* — Tuan N Nguyen
(74) *Attorney, Agent, or Firm* — Abelman, Frayne & Schwab

(57) ABSTRACT

A toilet multi flushing device consisting of an enclosed tank (3) filled with compressible plastic sheets (6). The tank (3) has a direct connection (1) to water supply at the bottom, an outlet at the bottom of the tank (3) with an external ball valve used as a flushing valve (10). When the valve (10) is opened the water is ejected at high speed to clear the bowl. It could be mixed with fresh air to form a mist flow. The mist streams clear the bowl. Fresh air could be substituted by the air from the trap (25) to create vacuum after the trap (25) to facilitate the clearing of the bowl.

7 Claims, 4 Drawing Sheets

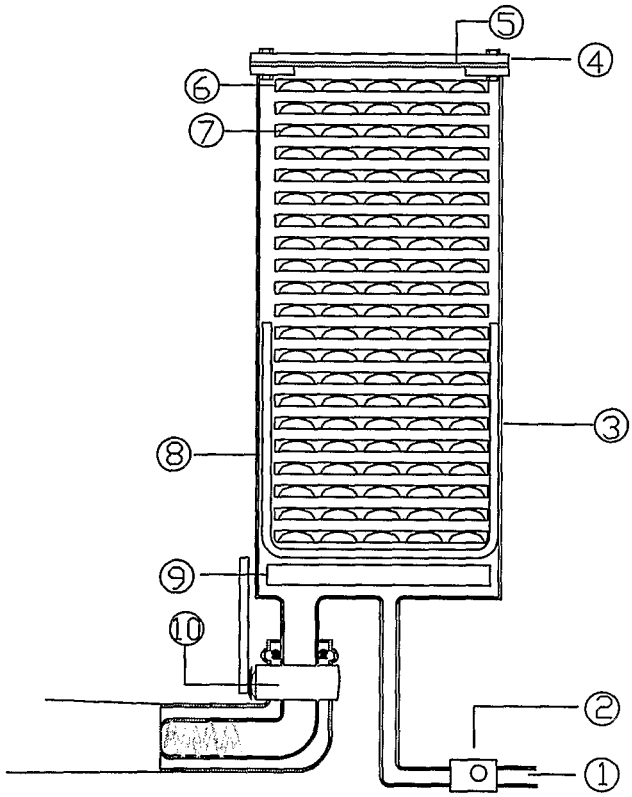
FIG (1)
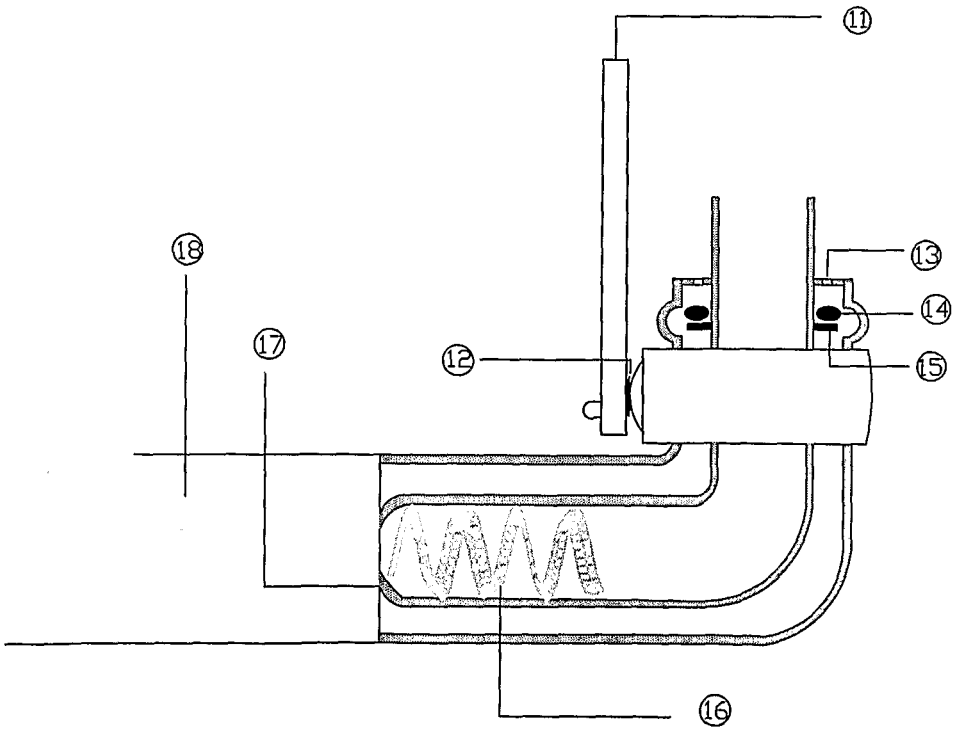
FIG (2)

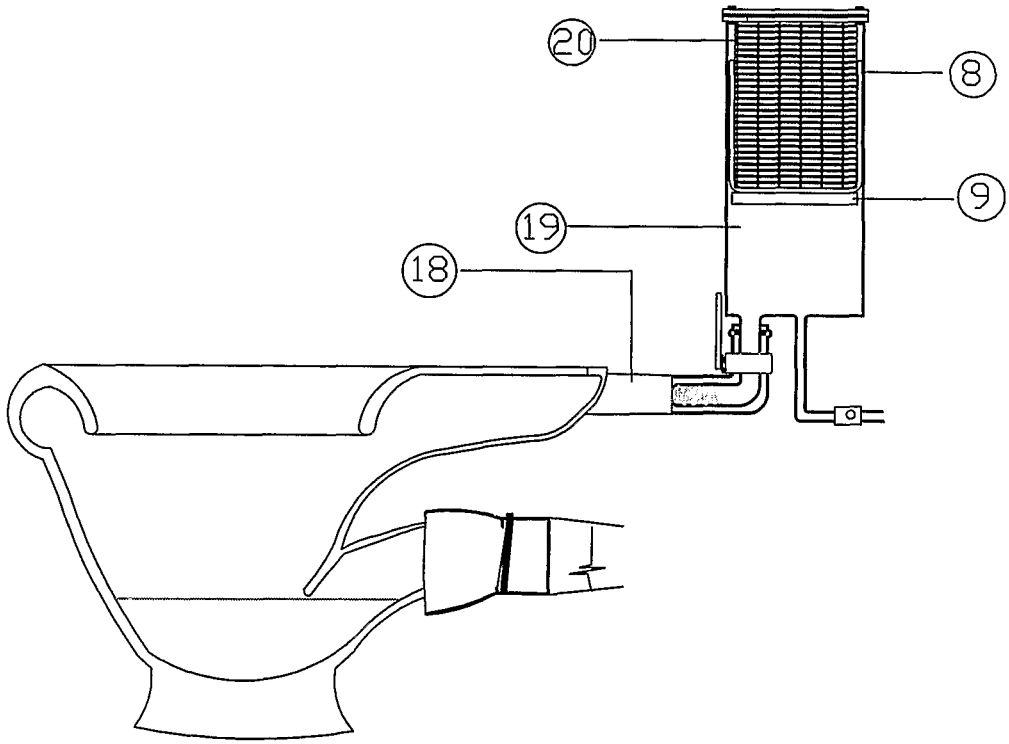
FIG (3)

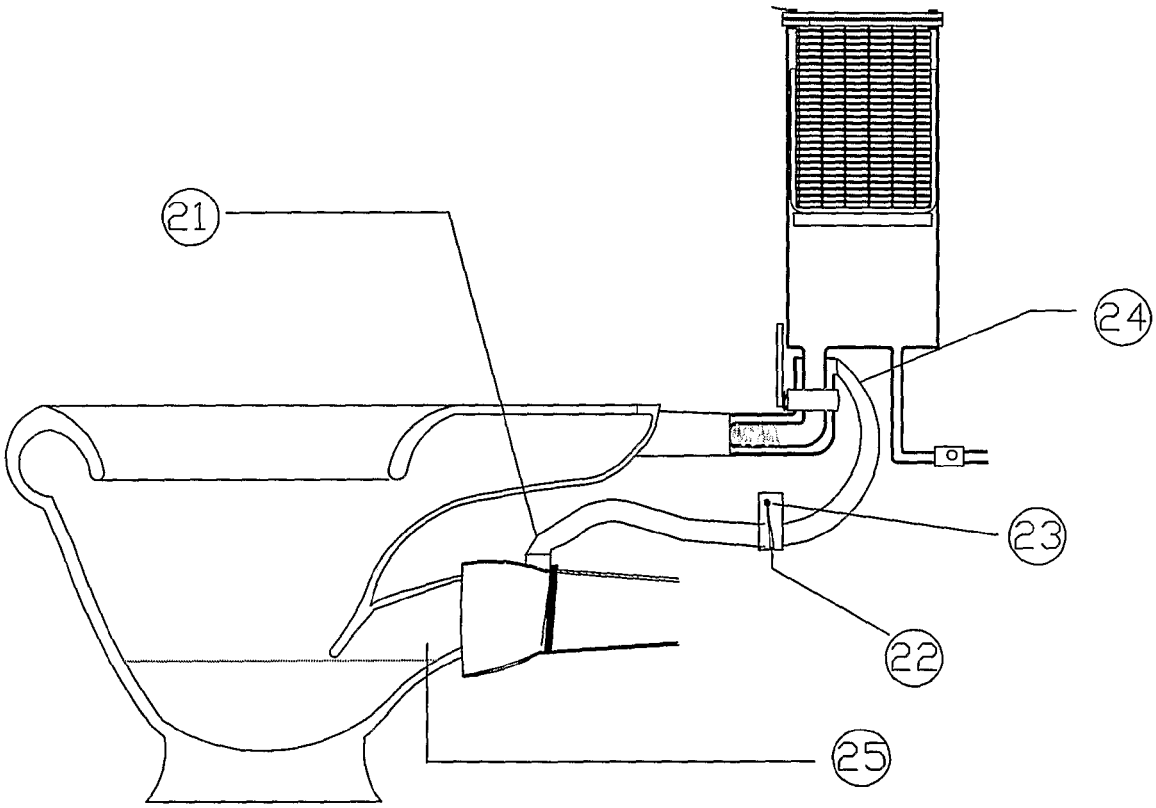
FIG (4)

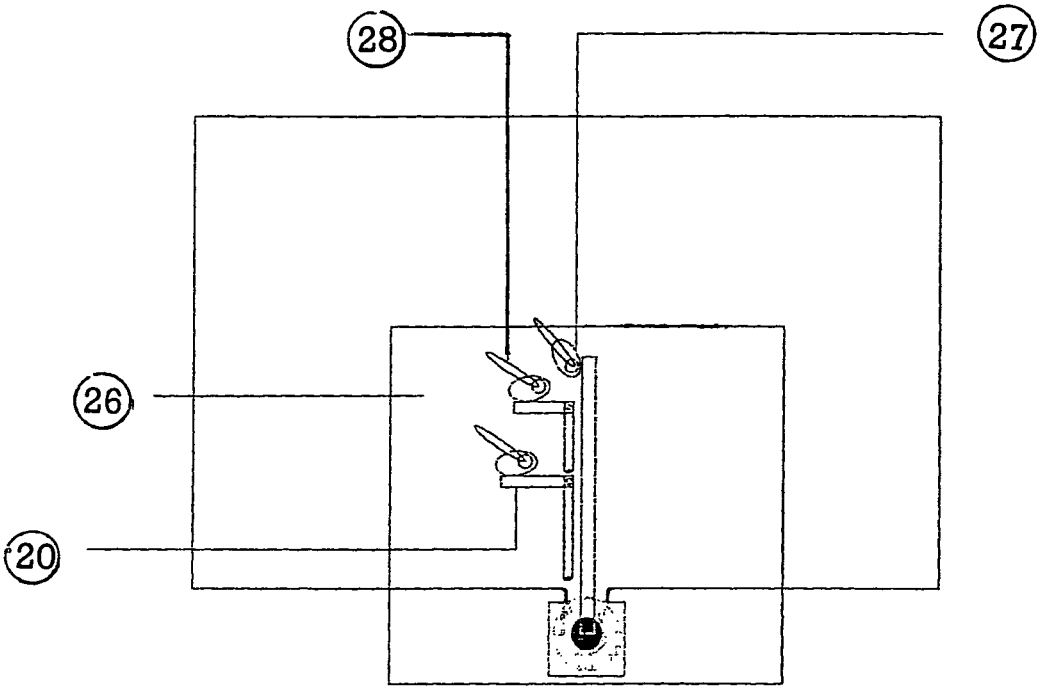
FIG (5)
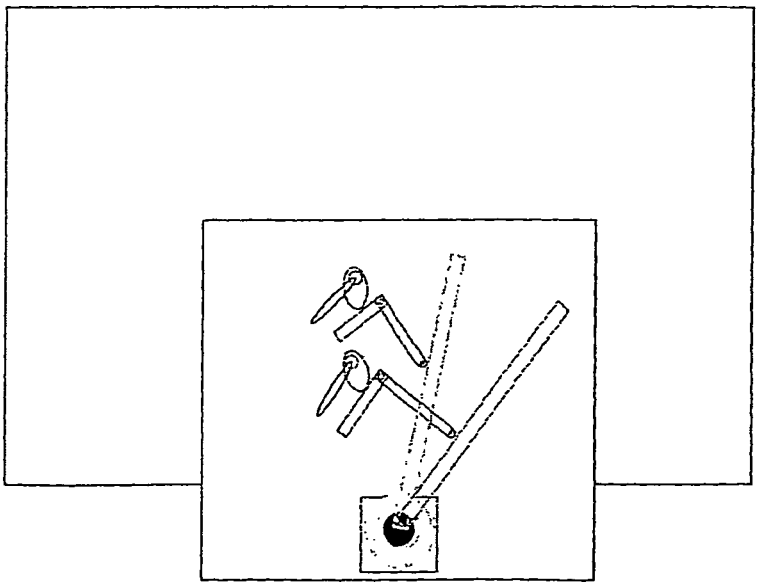
FIG (6)

MIST FLUSHING SYSTEM FOR TOILETS

TECHNICAL FIELD

Saving in water of flushing toilet by mixing compressed water with air, allow frequent flushing within short time.

BACKGROUND ART

Flushing bowl constitute a large portion of domestic water consumption, as the flushing water goes under the low gravity force, it consumes a lot of water, in addition to frequent leakage of the sensitive flushing valve, and the slow filling of tank which causes problem in public toilet. In this invention we used water under pressure stored in the tank .to generate high flow of mist for further saving of water, then we add vacuum generation in the trap for easy clearing of bowl. The three means could be joined in one system, or could be separated in steps.

Regular Flushing System has the Following Disadvantages 1. consumes a lot of water as gravity force is small
2. Flushing valve is very sensitive and needs continues maintenance.
3. continues leakage is common
4. flushing valve inside water causing rust
5. slow filling due to float valve
6. one flushing volume

Advantages of this Invention

1. Saving water by utilizing water and air at high pressure.
2. very simple and maintenance free
3. no leakage during normal use
4. valve is external
5. fast filling of tank
6. flushing volume could be controlled

DISCLOSURE OF INVENTION

The invention related to a multi flushing toilet device consisting of an enclosed tank filled with layers of sealed compressible air bubbles plastic sheets, the device has a direct connection to water supply at the bottom of the tank. During filling the sheets absorb the energy from the incoming water pressure, being compressed to equal pressure of the incoming water, the sheets act as an energy storing pad (pillow) an outlet at the bottom of the tank with an external ball valve used as flushing valve, the valve has a self return spring to close the valve after releasing the handle to do the flushing for a short time. When the valve opens, the air bubbles in the sheets expand and act as frictionless piston or spring to eject the water at a high speed. The ejected water passes through a spiral nozzle to from a cyclone flow of water to clear the bowl, or it goes through another larger nozzle of an external pipe. Then the ejected water will generate a high speed of drafted fresh air to be mixed with the water to from a strong mist flow to clear the bowl with small amount of water.

The quantity of water flowing after the valve closes could be adjusted to be enough to fill the trap. The duration of the valve opening could be controlled by the return spring of the valve and additional levers to gives different sizes of opening and timing. A regular size tank could provide consequent flushing instantly, as the single flushing will not empty the tank, and the filling is continuous without obstacles.

The fresh air generates the mist flow, could be substituted by sewage air, through connecting the air pipe to the trap pipe of the toilet to generate vacuum in the trap, this will facilitate clearing the bowl. This linkage could have the risk of bringing bad smell from the sewage, since this air will be washed by water during forming the mist, smell could be removed through washing, it depend on the water speed the ratio of air mixture, and the level of smell when the device is not in operation the air connection to the sewage pipe will be closed by a light swinging flap close to vertical position.

INDUSTRIAL APPLICABILITY

All materials are available in the market for different uses. The major requirement is changing the regular open flushing tank by a closed one, it must hold the pressure of the water. Most of the materials can meet this requirement.

DESCRIPTION OF DRAWING

The FIG. (1) shows the empty tank (3), from the bottom the water in (1), then the non return valve (2). the tank cover (4) with rubber gasket(5). The tank filled with air bubble sheets (6) the air bubble at its expanded(7) a separation basket (8) contain the down layer, of plastic sheets. It is mounted on floating pad (9) .then the outlet goes to the flushing ball valve (10)

FIG. (2) shows the detail of the flushing set .when the flash valve handle (11) turned, the water passes the spiral (16) to be ejected in a whirlpooling flow from the nozzle (17). The water drafts the surrounding air to form a mist, in the mist area (18). the fresh air input comes from the external pipe (13) it pass around a floating ring (14) which held at stopper (15) the coil spring (12) return the valve closed. In case the incoming flow exceed the draining water, water might goes backward in the external pipe, then the floating ring goes up, it closes the air passage (13) prevent water to overflow to the surrounding area.

FIG. (3) shows the tank being filled .the floating pad (9) goes upward holding the separation basket (8) and the air bubble sheets (6) under pressure .when the flushing valve (10) opened the water ejected and the mist clear the bowl.

FIG. (4) shows the replacement of fresh air input (13) by swage air input (24). When flushing take place, the drafted air swing the flap (22) at its hinge (23) allow the air to pass. It goes back to its place under gravity, after flushing, prevent odor to come in FIG. 5 shows flushing board held on flushing valve, the valve handle opens to three level through cams (27) and levers (28) each will allow different amount of flushing.

FIG. (6) shows the three flushing handle the top one will make the smallest flushing to flash urine, then the next make longer flushing, then the last one has the maxim flushing amount.

| | |
|---|---|
| (1) | Water in |
| (2) | Non return valve |
| (3) | Flushing tank |
| (4) | Cover of tank |
| (5) | Rubber gasket |
| (6) | Air bubble plastic sheets |
| (7) | Bubble in expansion mode |
| (8) | Separation basket |
| (9) | Flushing pad |
| (10) | Flushing ball valve |
| (11) | Handel of flushing valve |
| (12) | Coil spring of valve handle |

-continued

| | |
|---|---|
| (13) | Fresh air input |
| (14) | Floating gasket |
| (15) | Stopper of floating gasket |
| (16) | Spiral passage of water |
| (17) | Water jet nozzle |
| (18) | Mist forming area |
| (19) | Water under pressure |
| (20) | Plastic under compression |
| (21) | Air suction from trap |
| (22) | Self close swing flap |
| (23) | Hinge |
| (24) | Sewage air input |
| (25) | Trap |
| (26) | Flushing board |
| (27) | Cams |
| (28) | lever |

The invention claim is:

1. A mist flushing system for a toilet comprising:

a water tank having a sealed interior, an inlet for receiving water under pressure, and an outlet for supplying water under pressure;

at least one compressible material disposed in said tank interior which, when pressurized water is introduced into said interior, compresses to absorb and store energy; and a flushing valve assembly connected to said outlet, wherein said flushing assembly comprises a central pipe communicating with said outlet, wherein said central pipe has a spiral passage contained therein and an outlet nozzle for ejecting a whirlpooling flow of water from said tank into a chamber, and an outside air inlet opening into said chamber for mixing outside air with the whirlpooling flow of water to form a mist.

2. The mist flushing system of claim 1, wherein said outside air opening communicates with atmospheric air.

3. The mist flushing system of claim 1, further comprising a toilet having a water input communicating with said chamber and a trap; wherein said outside air opening communicates with said trap.

4. The mist flushing system of claim 1, wherein said at least one compressible material comprises layers of sealed compressible air bubble sheets to form a series of compressible bubbles.

5. The mist flushing system of claim 4, wherein said tank has an upper end, and wherein said sheets, prior to the introduction of pressurized water, occupy at least substantially all of the tank interior, and wherein incoming pressurized water compresses said sheets toward said upper end.

6. The mist flushing system of claim 5, comprising a basket disposed in said tank interior and housing at least a bottom portion of said sheets; wherein said basket moves toward said upper end along with said bottom portion when pressurized water compresses said sheets.

7. The mist flushing system of claim 1, wherein said flushing valve assembly includes a valve and a handle for actuating said valve, and further comprising at least two lever/cam pairs selectively acting on said handle for varying the length of the flush.

* * * * *